US005676257A

United States Patent [19]

Adkins

[11] Patent Number: 5,676,257

[45] Date of Patent: Oct. 14, 1997

[54] GUN RACK

[75] Inventor: John E. Adkins, Jacksonville, Fla.

[73] Assignee: At Ease Technologies, Inc., Claxton, Ga.

[21] Appl. No.: 639,616

[22] Filed: Apr. 29, 1996

[51] Int. Cl.[6] ..... E05B 73/00

[52] U.S. Cl. ..... 211/4; 211/64; 224/402; 224/913

[58] Field of Search ..... 211/4, 64; 224/402, 224/546, 913; 206/315.11; D6/552, 553

[56] References Cited

U.S. PATENT DOCUMENTS

| | | | |
|---|---|---|---|
| 2,668,645 | 2/1954 | Pease | 224/546 |
| 3,326,385 | 6/1967 | Pinkerton et al. | 224/913 X |
| 3,473,673 | 10/1969 | Porter | 224/913 X |
| 3,618,785 | 11/1971 | Newman | 211/4 |
| 3,643,811 | 2/1972 | Howerton | 211/4 X |
| 3,767,093 | 10/1973 | Pinkerton et al. | 224/546 X |
| 3,857,491 | 12/1974 | Townsend et al. | 224/913 X |
| 4,113,107 | 9/1978 | Jaeger | 211/64 X |
| 4,248,399 | 2/1981 | Gipson | 224/402 X |
| 4,298,151 | 11/1981 | O'Connor | 224/402 X |
| 4,375,268 | 3/1983 | Speck | 211/64 X |
| 4,450,989 | 5/1984 | Bogar, Jr. | 224/546 X |
| 4,596,334 | 6/1986 | Daulton | 224/402 X |
| 4,648,516 | 3/1987 | Elkins | 224/402 X |
| 5,129,563 | 7/1992 | Dillon | 224/913 X |
| 5,249,722 | 10/1993 | Horn | 224/913 X |
| 5,350,094 | 9/1994 | Morford | 224/402 X |
| 5,524,772 | 6/1996 | Simmons | 224/546 X |

*Primary Examiner*—Alvin C. Chin-Shue
*Assistant Examiner*—Sandra Snapp
*Attorney, Agent, or Firm*—John J. Byrne

[57] ABSTRACT

A gun rack for safely securing weapons which can be readily removed in an emergency. The securing mechanism is comprised of a pair of locking arms that are disposed over weapon-carrying cradles. Means are provided to lock the arms in this position. Key means are provided to unlock the arms and a movement of the arms sideways for less than an inch frees the weapons for removal. Guard means are provided for protecting the trigger mechanism while the weapon is in the rack.

6 Claims, 2 Drawing Sheets

GUN RACK

BACKGROUND OF THE INVENTION

For many years hunters and policemen have required racks where they can house and support rifles and shotguns in a safe mode and at the same time have them readily available for use.

The rack of this invention is described for securement to the panel of a pickup truck behind the front seats. However, it should be understood that the rack of this invention could be used on the roof of the vehicle as well as used along a home wall, a closet wall or over a fireplace or the like.

SUMMARY OF THE INVENTION

The invention relates to a construction whereby shotguns and rifles and other weapons of that type and shape can be readily stored in a secure position and at the same time be readily available for use.

A principal objective of this invention is to provide a locking bar with locking arms attached which can be readily removed from a lock position to an open position and also to provide a means by which a conventional locking mechanism can be readily utilized.

Another objective of this invention is to provide a gun rack in which the weapons are secured but will not be damaged because of contact with the storage mechanism.

These and other objectives of the invention will become readily apparent upon a reading of the following specification and claims taken with the drawings.

A BRIEF DESCRIPTION OF THE DRAWINGS

FIG. 1 a diagrammatic perspective of the gun rack of this invention;

DESCRIPTION OF THE PREFERRED EMBODIMENT

Figures 1, 2, 2A, 3, 4:
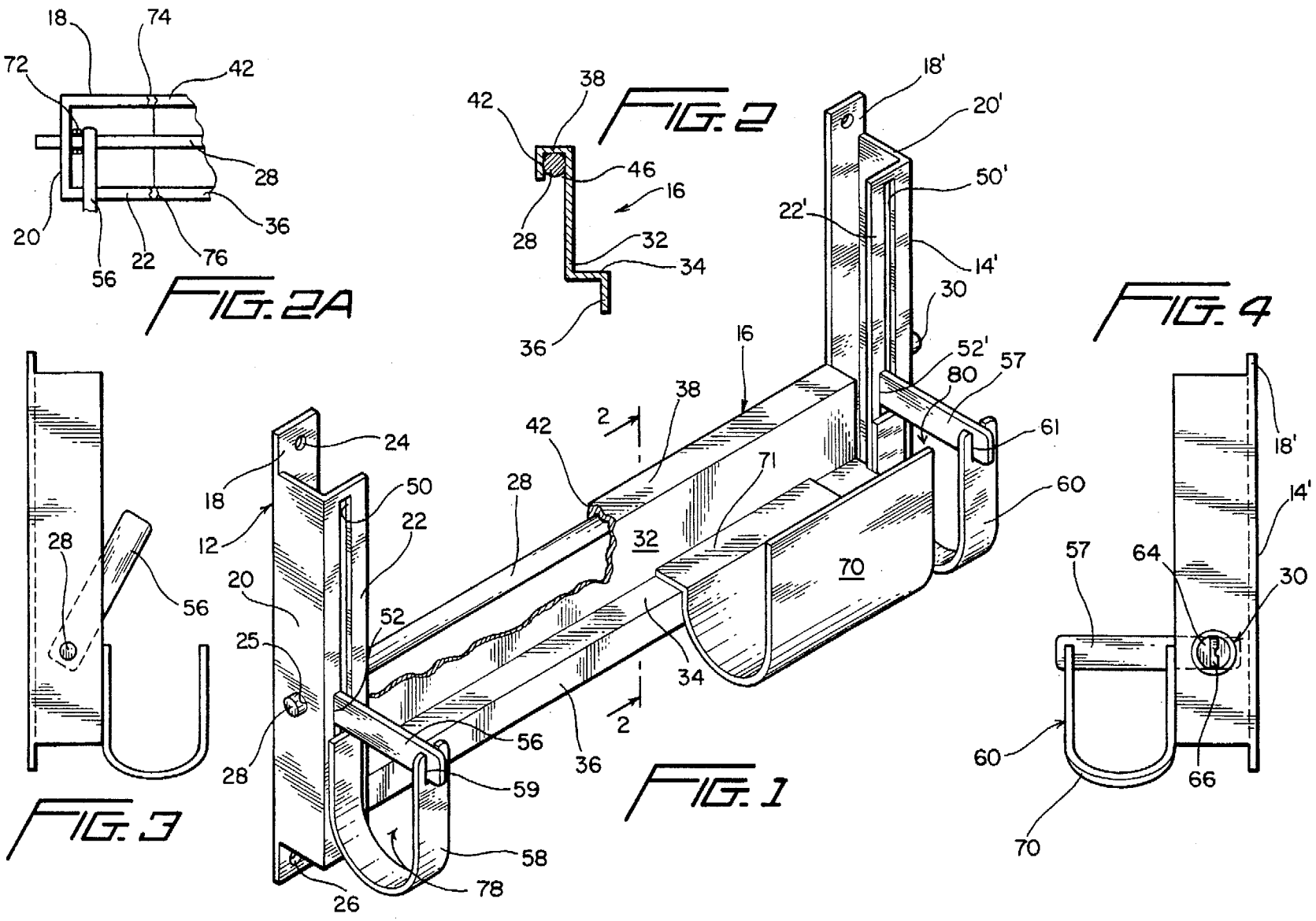
FIG. 2 is a cross-section along the line 2—2 of FIG. 1 showing only the cross-section of a cross-member.
FIG. 2A is a partial top view of an end member.
FIG. 3 is a left-hand side elevation of FIG. 1.
FIG. 4 is a right side elevation of FIG. 1.

Referring now to the drawings, wherein like numerals indicate like parts, the numeral 10 indicates the gun rack of this invention. A pair of mirror image vertical elongated U-bars 12 and 14 are connected by a cross-beam 16. These members are secured by the welds shown in FIG. 2.

The U-bar support beam 12 is formed of a wall plate 18, a base plate 20, and an inwardly directed plate 22 parallel to wall plate 18. Plate 18 is slightly longer than plates 20 and 22 and is provided at its upper and lower ends with apertures 24 and 26 to receive bolts or any other type fastener to secure the rack to a surface.

The U-bar 14 is generally the mirror image of support bar 12 and the corresponding parts in the latter are labeled with the same numerals with a prime mark. The base plate 20 is formed with an opening or bushing 25 to receive the outer end of a connecting rod 28 whose inner end is connected to a push key lock assembly 30.

The cross-beam 16 has a vertical section 32. Extending forwardly of ledge 32 is a horizontal section 34 and depending downwardly from the horizontal ledge 34 is a skirt member 36. At the upper end of section 32, there is a plate 38 and a return member 42 providing a housing-like chamber 46 for the connecting rod 28.

Formed in plates 22 and 22' are elongated slots 50 and 50' respectively. At the lower end of these slots are expansion chambers 52 and 52' each extending off to the left as viewed is FIGS. 1, 5 and 6.

Extending radially outwardly from the connecting rod 28 are locking arms 56 and 57. These locking arms are fixedly secured to rod 28 both longitudinally and radially. They move with the rod. As seen in FIG. 3, the locking arms pivot radially with the rod 28 and have their outer ends received by a pair of receiving depressions 59 and 61 formed in weapon cradles 58 and 60. The reception grooves or receiving depressions 59 and 61 formed at the outer ends of the cradles to receive the outer ends of locking arms 56 and 57. The receiving depressions 59 and 61 are wide enough to permit the arms 56 and 57 to move the distance of the slots 50 and 50' at their widest dimensions, e.g., at expansion chambers 52 and 52'.

Figure 5:
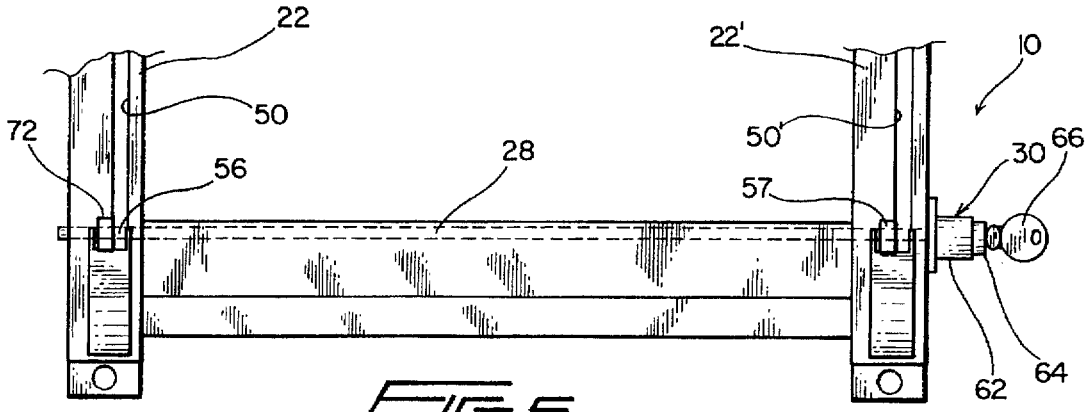
FIG. 5 is a front elevation with the locking levers (arms) in their locked position.

As seen in FIG. 5, the rod 28 is equipped with a conventional, key operated, push lock assembly 30 at its inner or other end. The assembly 30 has a housing 62 that receives a push button 64 which has an opening therein to receive a locking key 66. The inner end of the push button is connected to the end of rod 28.

Figure 6:
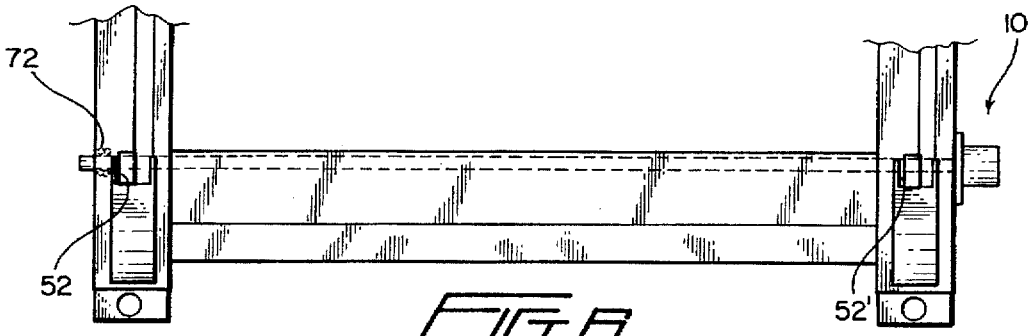
FIG. 6 is a front elevation with the locking levers (arms) in their open position.
Figure 7:
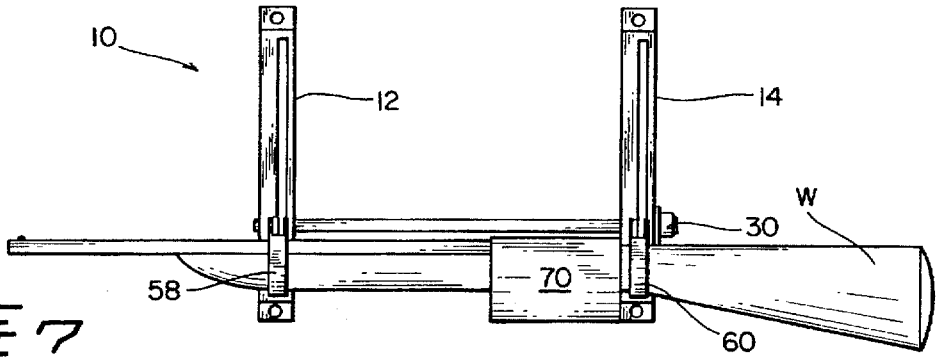
FIG. 7 shows the previously described rack with a weapon secured therein.
Figure 8:
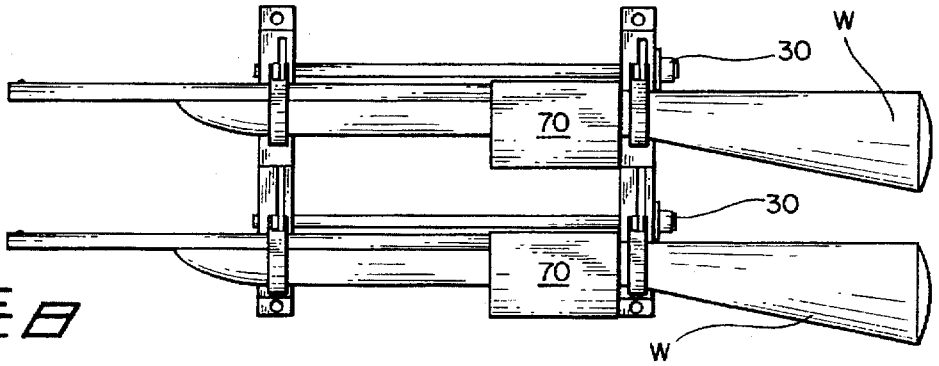
FIG. 8 is a view similar to FIG. 7 showing the rack accommodating several guns.

As seen in FIG. 5, the gun rack 10 is in its open position; that is, when locking arms 56 and 57 swing upwardly into slots 50 and 50' in plates 22 and 22'. However, when the locking arms are lowered and the rod 28 is pushed to the left, as seen in FIG. 6, the locking arms move into the expansion chambers 52 and 52' from which they cannot pivot. Thus a weapon W is received by the weapon cradles 58 and 60 (as seen in FIGS. 7 and 8) cannot be removed therefrom.

A U-shaped stainless steel trigger safety guard 70 has a flange 71 welded to the horizontal ledge 34 of the cross-beam 16. This member extends slightly below the cradle members as seen in FIG. 4. (The components heretofore described are normally of polished stainless steel and the connection between members is by welding where appropriate.)

The push lock assembly 30 is of a conventional type that does not require the key in order to push the button member inwardly to lock the weapon. However, to cause the rod 28 to move to the right so that the locking arms can be received by their receiving slots 50 and 50', the key 66 is required. It should be noted that the depressions 59 and 61 on the outer ends of the gun cradles have horizontal widths approximating the widths of slots 50 and 50' at their widest points. A coil spring 72 is mounted about rod 28 between base plate 20 and the locking arm 56. This biases the rod assembly toward the open position.

The trigger safety guard 70 itself is of rolled steel and disposed over the trigger firing mechanism of the weapon so as to prevent accidental firing thereof. Additionally, this guard 70 allows for protection of the weapon from being dismantled at the breech and removed from the rack. As seen in FIGS. 7 and 8 the rack is readily adaptable to receive more than one weapon. FIG. 2A shows weld lines 74 and 76. As can be seen, the edge of the skirt 36 is welded to the inner edge of plate 22 and the edge of return 42 welded to the edge of plate 18.

The upper ends of the U-shaped cradles 58 and 60 define openings 78 and 80 such that the openings are closed when arms 56 and 57 are positioned in the locked positions shown in FIG. 1. Connecting rod 28 is disposed laterally of said upper ends. See FIG. 3.

A preferred embodiment of the invention has been described but it should be understood that the scope of protection shall be determined by the Claims hereof.

I claim:

1. A gun rack for securing rifles or shotguns therein comprising in combination;

a pair of spaced elongated supports, each support having a U-shaped cross-section and each support comprised of a wall plate, a front plate parallel to said wall plate and a base plate connecting said wall plate and said front plate, a cross member connecting said pair of supports, a connecting rod extending between said supports, a means rotatably supporting said rod in said supports, a pair of locking arms longitudinally spaced from one another, a second means securing said arms to said rod in fixed radial relationship and said locking arms having an open position and a lock position a pair of U-shaped cradles to support a weapon and each having one of its legs welded to one of said front plates, and its other leg member having a notch to receive said locking arms, said front plates having grooves along their lengths to receive said arms in their open positions and said arms supported in said notch while in the locked position.

2. The invention of claim 1 wherein a push lock is mounted on one end of said rod, a spring biasing said arms toward said push lock, said spring biasing said arms to said open position.

3. The invention of claim 2 wherein said push lock has a button to push said rod against the bias of said spring.

4. The invention of claim 3 wherein a lock is provided to secure said rod and said arms in said lock position.

5. A weapon rack comprising a framework, a cradle means having a top opening for supporting the weapon, first means affixing said cradle means to said framework, a rod rotatably secured in said framework and disposed laterally from said opening, first and second arms fixedly secured to said rod, second means to move said arms from a first position away from said opening and to a second position disposing said arms over said opening of said cradle means to secure a weapon in said cradle means, and third means to lock said arms in said lock position.

6. The invention of claim 5 wherein said arms, when moved to said open position, are partially received by slots in said framework.

* * * * *